US006425582B1

(12) United States Patent
Rosi

(10) Patent No.: US 6,425,582 B1
(45) Date of Patent: Jul. 30, 2002

(54) GANGSTER BOARD GAME

(76) Inventor: Joe Rosi, 4291 Highgate Crescent, Mississauga, Ontario (CA), L4W 3G8

( * ) Notice: Subject to any disclaimer, the term of this patent is extended or adjusted under 35 U.S.C. 154(b) by 0 days.

(21) Appl. No.: 09/621,481

(22) Filed: Jul. 21, 2000

(51) Int. Cl.[7] ..... A63F 1/00
(52) U.S. Cl. ..... 273/243; 273/243; 273/292
(58) Field of Search ..... 273/292, 300, 273/302, 308, 250–54, 236, 243

(56) References Cited

U.S. PATENT DOCUMENTS

| | | | | |
|---|---|---|---|---|
| 2,177,078 | A | * | 10/1939 | Raizen |
| D134,515 | S | | 12/1942 | Long |
| 3,977,680 | A | | 8/1976 | Lavine |
| 4,566,698 | A | | 1/1986 | Sneden |
| 4,625,970 | A | * | 12/1986 | Childs |
| 4,640,513 | A | * | 2/1987 | Montijo |
| 4,953,871 | A | * | 9/1990 | Antwi |
| 5,033,752 | A | | 7/1991 | Bunting |
| 5,118,113 | A | * | 6/1992 | Ahlers |
| 5,183,258 | A | * | 2/1993 | Lerke |
| 5,318,447 | A | * | 6/1994 | Mooney |
| 5,476,264 | A | | 12/1995 | Ortega |
| 5,547,201 | A | * | 8/1996 | Honeywill |
| 6,120,296 | A | * | 9/2000 | Lim |

OTHER PUBLICATIONS

Gameplay Janrary 84 (12 pages).*

* cited by examiner

*Primary Examiner*—Benjamin H. Layno
*Assistant Examiner*—V K Mendiratta

(57) ABSTRACT

A gangster board game for play by a plurality of players until a winner is declared by being the first player to complete all of their assigned instructions of their contract card. The gangster board game includes a game board having a plurality of playing spaces arranged in a pair of paths including an inner location path and an outer sidewalk path. The playing spaces forming the inner location path are designated location playing spaces and the playing spaces forming the outer sidewalk path arc designated sidewalk playing spaces. Each of the location playing spaces is assigned a unique game location and having indicia indicating the unique game location of the respective location playing spaces. Each of the sidewalk playing spaces being having unique playing instructions displayed therein. Each player is assigned a playing piece and corresponding police record sheet to each player, a sum of the play money, a contract card and a contract recording sheet. A plurality of sequential player turns are performed comprising rolling a die, moving the playing piece of the player a number of sidewalk playing spaces corresponding to the value rolled on the normal die, performing the instructions displayed on the sidewalk space on which the playing piece terminates its move on, performing the instructions of the steps of the contact card of the player, and recording completion of the performed instructions of the steps of the contract card of the player. The first player to complete performance of all of the instructions of all of the steps of their contract card is declared the winner.

7 Claims, 6 Drawing Sheets

17

22

| | STEP1 | STEP2 | STEP3 | STEP4 | STEP5 | STEP6 |
|---|---|---|---|---|---|---|
| CONTRACT1 | | | | | | |
| CONTRACT2 | | | | | | |
| CONTRACT3 | | | | | | |
| CONTRACT4 | | | | | | |
| CONTRACT5 | | | | | | |
| CONTRACT6 | | | | | | |

PLEASE HAVE BANKER CHECK OFF
EVERY STEP YOU COMPLETE

FIG. 9

POLICE RECORD

POLICE RECORD

POLICE RECORD

POLICE RECORD

File # 758429 POLICE RECORD

Name Tony Mangiadorma
A.K.A "Fingers",Sleeps,Glue
Date of Birth 1961,October,3
City Detroit,Michigan
Sex Male
Height 5'-9"
Other info Got his name because he's a kleptomanic Photo Finger Prints R.Thumb R.Index R.Middle R.Ring R.baby

DATE CONVICTIONS,CHARGES, OTHER ACTIONS

1977-ARRESTED & CHARGED WITH POSSESSION OF STOLEN SCHOOL PROPERTY WITH INTENT TO SELL-EST WORTH OVER $75,000--SENTENCED TO JUV. DETENTION CENTER UNTIL 18TH BIRTHDAY
1979-ARRESTED & CHARGED WITH POSSESSION OF STOLEN PROPERTY (WORTH OVER $5,000) WITH INTENT TO SELL--SELLING USED AUTO PARTS OUT OF HIS GARAGE--SENTENCED TO 3 YEARS STATE PEN-OUT AFTER 1 ON GOOD BEHAVIOR
1981-SUSPECTED OF ARMED ROBBERY OF DETROIT NATIONAL BANK-$9,585 STOLEN NOT ENOUGH EVIDENCE TO PRESS CHARGES --CASE STILL UNDER INVESTIGATION
1981-SUSPECTED OF ATTEMPTED ARMED ROBBERY OF JEWELRY STORE--PERP TRIGGERED SILENT ALARM-CAUGHT OFF GUARD BY ONCOMING SECURITY--SHOOT-OUT BUT NO INJURIES--NOT ENOUGH EVIDENCE TO PLACE AT SCENE CASE STILL OPEN
1982-SUSPECTED MEMBER OF FUSILLI CRIME FAMILY
1984-ARRESTED & CHARGED WITH ARMED ROBBERY OF A JEWELRY STORE-6 MONTH INVESTIGATION LED TO THE KNOWLEDGE THAT IT WAS A FOUR MAN TEAM-- HE WAS THE ONLY ONE APPREHENDED--DIDN'T FLIP--$350 G'S STOLEN--SENTENCED TO 10 YEARS IN STATE PEN--OUT AFTER 7 ON GOOD BEHAVIOR
1992-SUSPECTED OF ARMED ROBBERY(JEWELRY STORE)--OVER 500G'S STOLEN IN MERCHANDISE-4 MAN CREW MATCHING HIS M.O. NOT ENOUGH EVIDENCE TO ARREST -- CASE STILL OPEN
1993-SUSPECTED OF ARMED ROBBERY (NAT. BANK)- OVER 450G'S--STOLEN 4 MAN CREW MATCHING HIS M.O.--NOT ENOUGH EVIDENCE TO ARREST-- STILL OPEN
1995-SUSPECTED OF ARMED ROBBERY- BULLET AIRLINE-TRANPORTING MUSEUM SHIPMENT FROM PARIS(PAINTING,SCULPTURES,ETC.) EST. WORTH OVER 4 MIL.--1 MAN CAUGHT(4 MAN CREW)--WOULDN'T FLIP--STILL OPEN
1996-ARRESTED & CHARGED WITH POSSESSION OF AN ILLEGAL WEAPON--PULLED OVER FOR TRAFFIC VIOLATION--POLICEMAN PETERSON SAW THE NOSE OF A SEMI-AUTO STICKING OUT FROM UNDER DRIVER'S SEAT--$2000 FINE,1 YEAR SUSPENDED SENTENCE

16

FIG. 10

20

WITNESS PROTECTION PROGRAM

FIG. 11

20

PLEASE OBTAIN A NEW IDENTITY AND 6 NEW CONTRACTS AND START THE GAME FROM THE BEGINNING

GANGSTER BOARD GAME

BACKGROUND OF THE INVENTION

1. Field of the Invention

The present invention relates to board games and more particularly pertains to a new gangster board game for play by a plurality of players until a winner is declared by being the first player to complete all of their assigned instructions of their contract card.

2. Description of the Prior Art

The use of board games is known in the prior art. More specifically, board games heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,566,698; U.S. Pat. No. 5,033,752; U.S. Pat. No. 3,977,680; U.S. Pat. No. 5,476,264; U.S. Pat. No. 2,177,078; and U.S. Pat. No. Des. 134,515.

While these devices fulfill their respective, particular objectives and requirements, the aforementioned patents do not disclose a new gangster board game. The inventive device includes a game board having a plurality of playing spaces arranged in a pair of paths including an inner location path and an outer sidewalk path. The playing spaces forming the inner location path are designated location playing spaces and the playing spaces forming the outer sidewalk path are designated sidewalk playing spaces. Each of the location playing spaces is assigned a unique game location and having indicia indicating the unique game location of the respective location playing spaces. Each of the sidewalk playing spaces being having unique playing instructions displayed therein. Each player is assigned a playing piece and corresponding police record sheet to each player, a sum of the play money, a contract card and a contract recording sheet. A plurality of sequential player turns are performed comprising rolling a die, moving the playing piece of the player a number of sidewalk playing spaces corresponding to the value rolled on the normal die, performing the instructions displayed on the sidewalk space on which the playing piece terminates its move on, performing the instructions of the steps of the contact card of the player, and recording completion of the performed instructions of the steps of the contract card of the player. The first player to complete performance of all of the instructions of all of the steps of their contract card is declared the winner.

In these respects, the gangster board game according to the present invention substantially departs from the conventional concepts and designs of the prior art, and in so doing provides an apparatus primarily developed for the purpose of play by a plurality of players until a winner is declared by being the first player to complete all of their assigned instructions of their contract card.

SUMMARY OF THE INVENTION

In view of the foregoing disadvantages inherent in the known types of board games now present in the prior art, the present invention provides a new gangster board game construction wherein the same can be utilized for play by a plurality of players until a winner is declared by being the first player to complete all of their assigned instructions of their contract card.

The general purpose of the present invention, which will be described subsequently in greater detail, is to provide a new gangster board game apparatus and method which has many of the advantages of the board games mentioned heretofore and many novel features that result in a new gangster board game which is not anticipated, rendered obvious, suggested, or even implied by any of the prior art board games, either alone or in any combination thereof.

To attain this, the present invention generally comprises a game board having a plurality of playing spaces arranged in a pair of paths including an inner location path and an outer sidewalk path. The playing spaces forming the inner location path are designated location playing spaces and the playing spaces forming the outer sidewalk path are designated sidewalk playing spaces. Each of the location playing spaces is assigned a unique game location and having indicia indicating the unique game location of the respective location playing spaces. Each of the sidewalk playing spaces being having unique playing instructions displayed therein. Each player is assigned a playing piece and corresponding police record sheet to each player, a sum of the play money, a contract card and a contract recording sheet. A plurality of sequential player turns are performed comprising rolling a die, moving the playing piece of the player a number of sidewalk playing spaces corresponding to the value rolled on the normal die, performing the instructions displayed on the sidewalk space on which the playing piece terminates its move on, performing the instructions of the steps of the contact card of the player, and recording completion of the performed instructions of the steps of the contract card of the player. The first player to complete performance of all of the instructions of all of the steps of their contract card is declared the winner.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new gangster board game apparatus and method which has many of the advantages of the board games mentioned heretofore and many novel features that result in a new gangster board game which is not anticipated, rendered obvious, suggested, or even implied by any of the prior art board games, either alone or in any combination thereof.

It is another object of the present invention to provide a new gangster board game which may-be easily and efficiently manufactured and marketed.

It is a further object of the present invention to provide a new gangster board game which is of a durable and reliable construction.

An even further object of the present invention is to provide a new gangster board game which is susceptible of a low cost of manufacture with regard to both materials and labor, and which accordingly is then susceptible of low prices of sale to the consuming public, thereby making such gangster board game economically available to the buying public.

Still yet another object of the present invention is to provide a new gangster board game which provides in the apparatuses and methods of the prior art some of the advantages thereof, while simultaneously overcoming some of the disadvantages normally associated therewith.

Still another object of the present invention is to provide a new gangster board game for play by a plurality of players until a winner is declared by being the first player to complete all of their assigned instructions of their contract card.

Yet another object of the present invention is to provide a new gangster board game which includes a game board having a plurality of playing spaces arranged in a pair of paths including an inner location path and an outer sidewalk path. The playing spaces forming the inner location path are designated location playing spaces and the playing spaces forming the outer sidewalk path are designated sidewalk playing spaces. Each of the location playing spaces is assigned a unique game location and having indicia indicating the unique game location of the respective location playing spaces. Each of the sidewalk playing spaces being having unique playing instructions displayed therein. Each player is assigned a playing piece and corresponding police record sheet to each player, a sum of the play money, a contract card and a contract recording sheet. A plurality of sequential player turns are performed comprising rolling a die, moving the playing piece of the player a number of sidewalk playing spaces corresponding to the value rolled on the normal die, performing the instructions displayed on the sidewalk space on which the playing piece terminates its move on, performing the instructions of the steps of the contact card of the player, and recording completion of the performed instructions of the steps of the contract card of the player. The first player to complete performance of all of the instructions of all of the steps of their contract card is declared the winner.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 9 is a schematic perspective view a plurality of police record cards of the present invention.

FIG. 10 is a schematic plan view of a front of a witness protection program card.

FIG. 11 is a schematic plan view of a back of a witness protection program card.

DESCRIPTION OF THE PREFERRED EMBODIMENT

With reference now to the drawings, and in particular to FIGS. 1 through 15 thereof, a new gangster board game embodying the principles and concepts of the present invention will be described.

As best illustrated in FIGS. 1 through 15, the gangster board game generally comprises a game board having a plurality of playing spaces arranged in a pair of paths including an inner location path and an outer sidewalk path. The playing spaces forming the inner location path are designated location playing spaces and the playing spaces forming the outer sidewalk path are designated sidewalk playing spaces. Each of the location playing spaces is assigned a unique game location and having indicia indicating the unique game location of the respective location playing spaces. Each of the sidewalk playing spaces being having unique playing instructions displayed therein. Each player is assigned a playing piece and corresponding police record sheet to each player, a sum of the play money, a contract card and a contract recording sheet. A plurality of sequential player turns are performed comprising rolling a die, moving the playing piece of the player a number of sidewalk playing spaces corresponding to the value rolled on the normal die, performing the instructions displayed on the sidewalk space on which the playing piece terminates its move on, performing the instructions of the steps of the contact card of the player, and recording completion of the performed instructions of the steps of the contract card of the player. The first player to complete performance of all of the instructions of all of the steps of their contract card is declared the winner.

Figure 1:
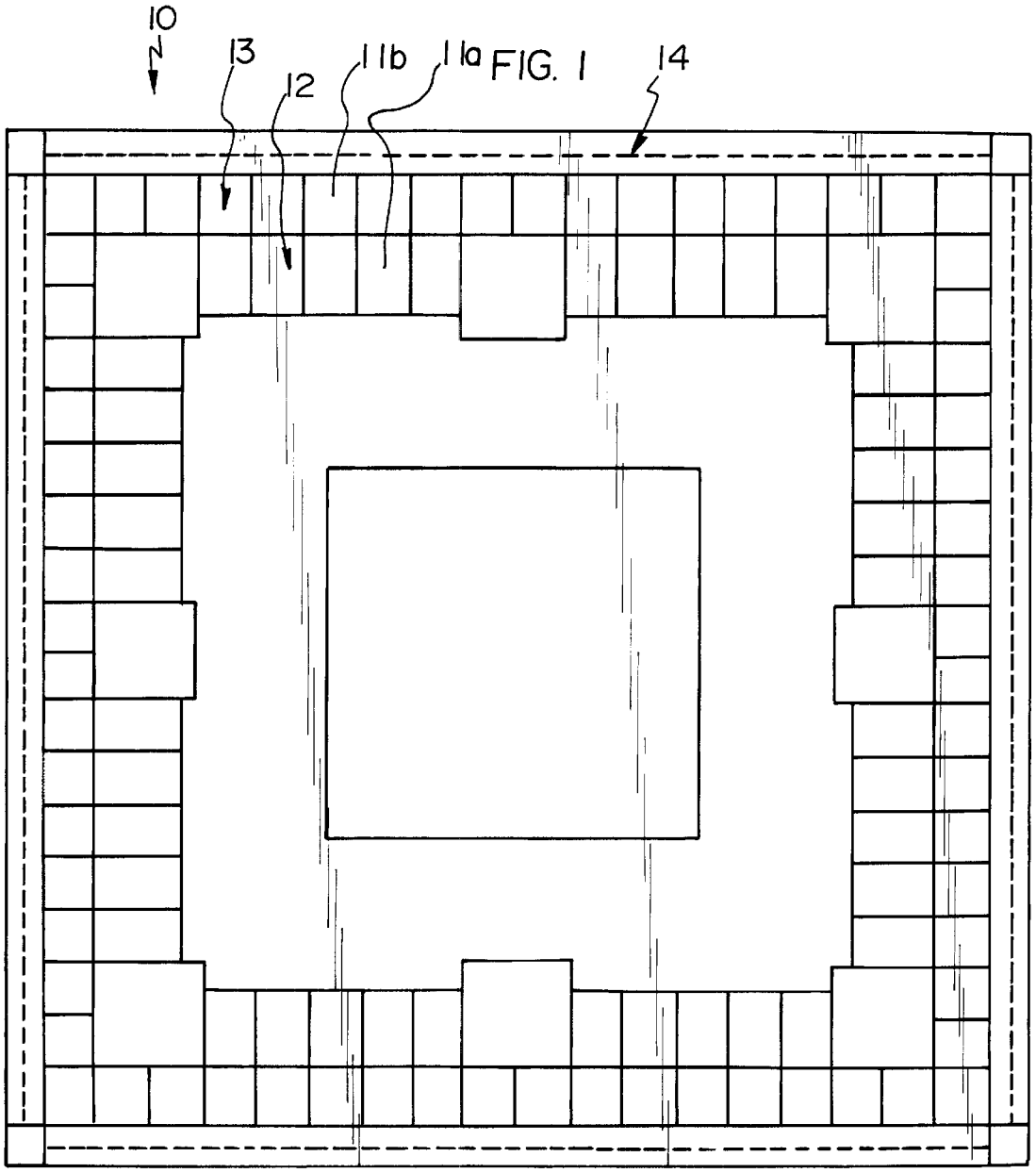
FIG. 1 is a schematic plan view of the layout of the game board.
Figures 2, 3:
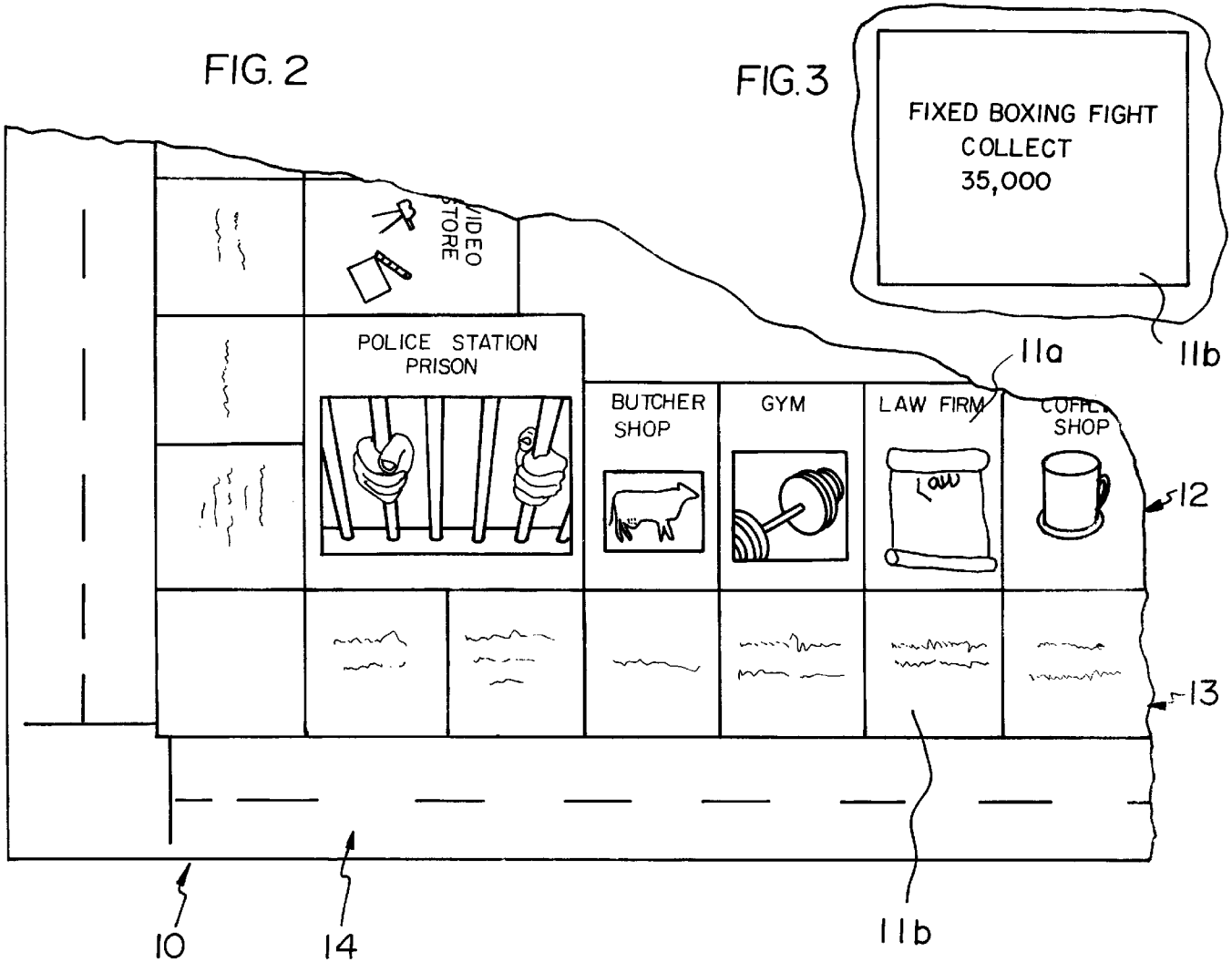
FIG. 2 is a schematic enlarged plan view of a portion of the game board.
FIG. 3 is a schematic enlarged plan view of a sidewalk playing space.

In closer detail, the gangster board game is designed for a plurality of players preferably between two players and twelve players. With reference to FIGS. 1, 2, and 3, the game is played on a generally rectangular game board 10 having a generally rectangular outer perimeter with a plurality of generally rectangular playing spaces 11*a*, 11*b* arranged in a pair of generally rectangular paths along the outer perimeter of the game board. The pair of paths includes an inner location path 12 and an outer sidewalk path 13. The outer sidewalk path is interposed between the inner location path and the outer perimeter of the game board. Preferably, the game board has a generally rectangular road path 14 extending along the outer perimeter and interposed between the outer sidewalk path and the outer perimeter of the game board.

The playing spaces 11*a* forming the inner location path are designated location playing spaces and the playing spaces 11*b* forming the outer sidewalk path are designated sidewalk playing spaces. As best illustrated in FIG. 2, each of the location playing spaces is assigned a unique game location (such as a jail space and a casino space) and has indicia indicating the unique game location of the respective location playing spaces. As illustrated in FIG. 3, each of the sidewalk playing spaces has unique playing instructions displayed therein. Some examples of sidewalk playing spaces include: a "go to jail" sidewalk space; "judge", "lawyer", "politician", "dirty cop" spaces; a "trivia" space; a "Shi-lock" space; a "picked up for questioning" space; a "subpoenaed (to appear at Senate hearings)" space; a "Vegas" space; a "That's a beautiful thing" space; and a "45 & A Shovel" space.

Also provided in the game are a plurality of playing pieces 15 each representing a unique player character. Preferably, the plurality of playing pieces comprises twenty playing pieces.

With reference to FIG. 9, a plurality of police record sheets 16 are provided with each police record sheet being associated with a corresponding one of the player characters. Each of the police record sheets displays a simulated mug shot/photo, a simulated set of fingerprints, name, aliases, and simulated prior convictions of the corresponding player character.

Figures 7, 8:
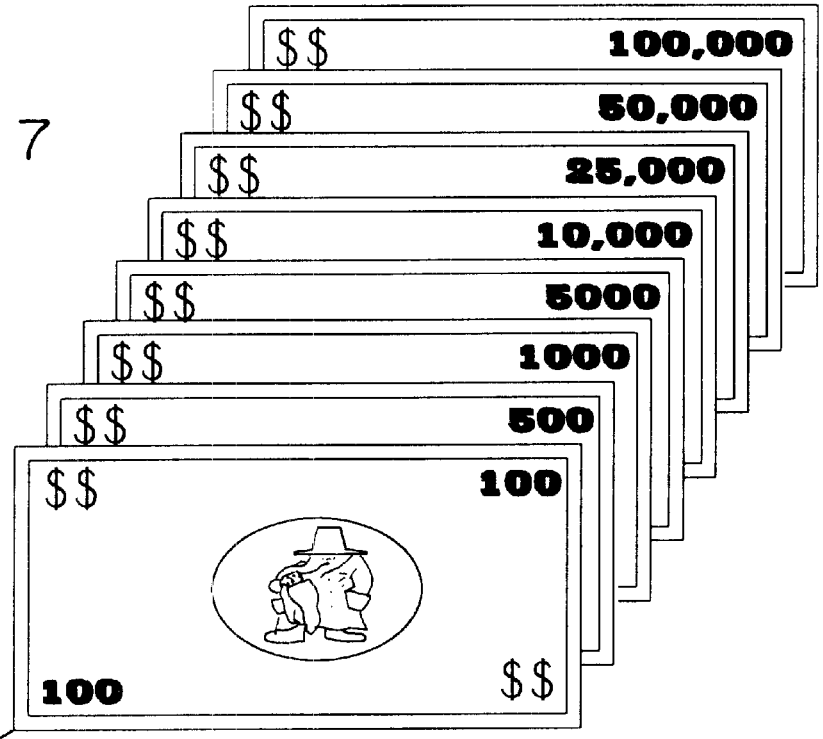
FIG. 7 is a schematic perspective view of some play money of the present invention.
FIG. 8 is a schematic plan view of a contract recording sheet.

As illustrated in FIG. 7, a plurality of play money 17 is provided in a variety of denominations preferably having a sum of at least $10,000,000 of play money for providing sufficient play money to play a game. Also included are a plurality of dice including a normal die 18 and a loaded or biased die. Ideally, a giant Godfather ring is also provided to be worn by the winner of the game.

Figure 14:
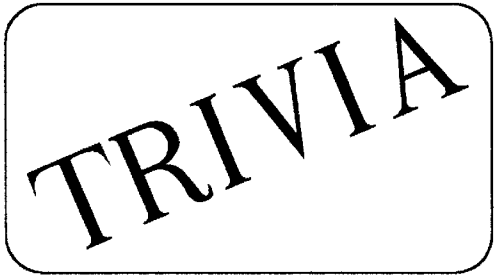
FIG. 14 is a schematic plan view of a front of a trivia card.
Figure 15:
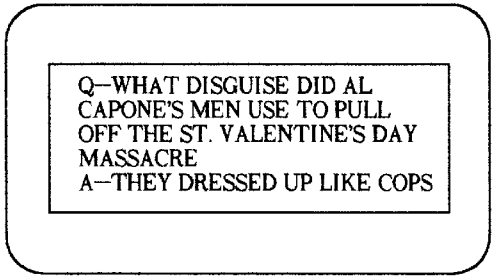
FIG. 15 is a schematic plan view of a back of a contract card.

With reference to FIGS. 14 and 15, the game includes a deck of trivia cards 19 with each trivia card having a trivia question and corresponding correct answer relating to an organized crime subject displayed thereon as shown in FIG. 15. A deck of witness protection program cards 20 are also provided. As illustrated in FIGS. 10 and 11, each witness protection program card having a unique set of instructions displayed on for a player to perform.

Figure 12:
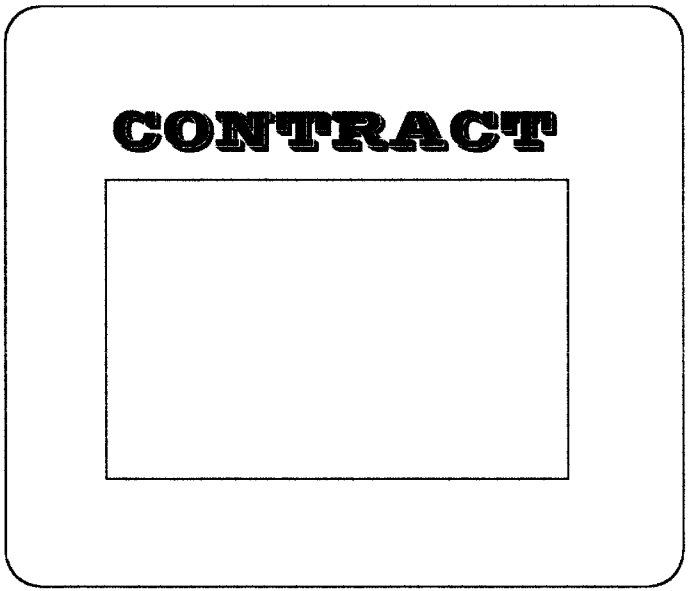
FIG. 12 is a schematic plan view of a front of a contract card.
Figure 13:
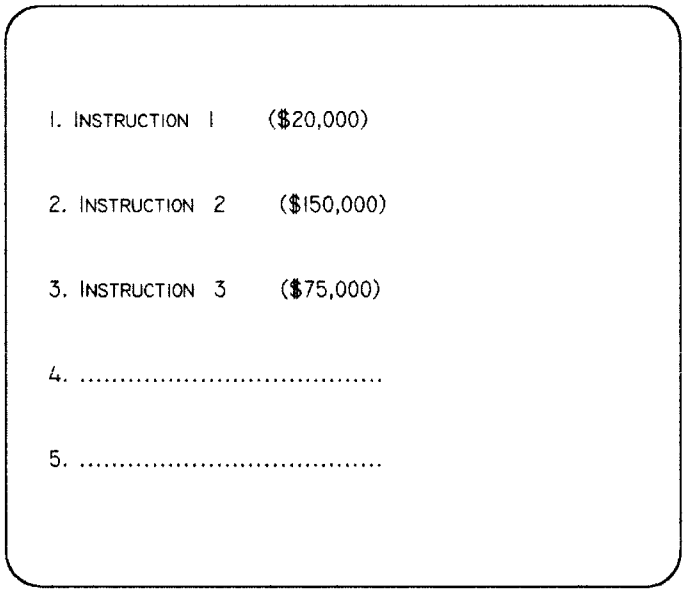
FIG. 13 is a schematic plan view of a back of a contract card illustrating the sets of instructions of the contract card.

With reference to FIGS. 12 and 13, a plurality of contract cards 21 are also provided. As best shown in FIG. 13, on the back of each contract card are a plurality of steps with each step comprising a set of instructions and an associated cost for the respective step. A plurality of contract recording sheets 22 are also included as illustrated in FIG. 8 with each contract recording sheet having a grid of generally rectangular boxes 23 displayed thereon displayed thereon and indicia indicating contracts along one side of the grid and steps along another side of the grid.

Figure 4:
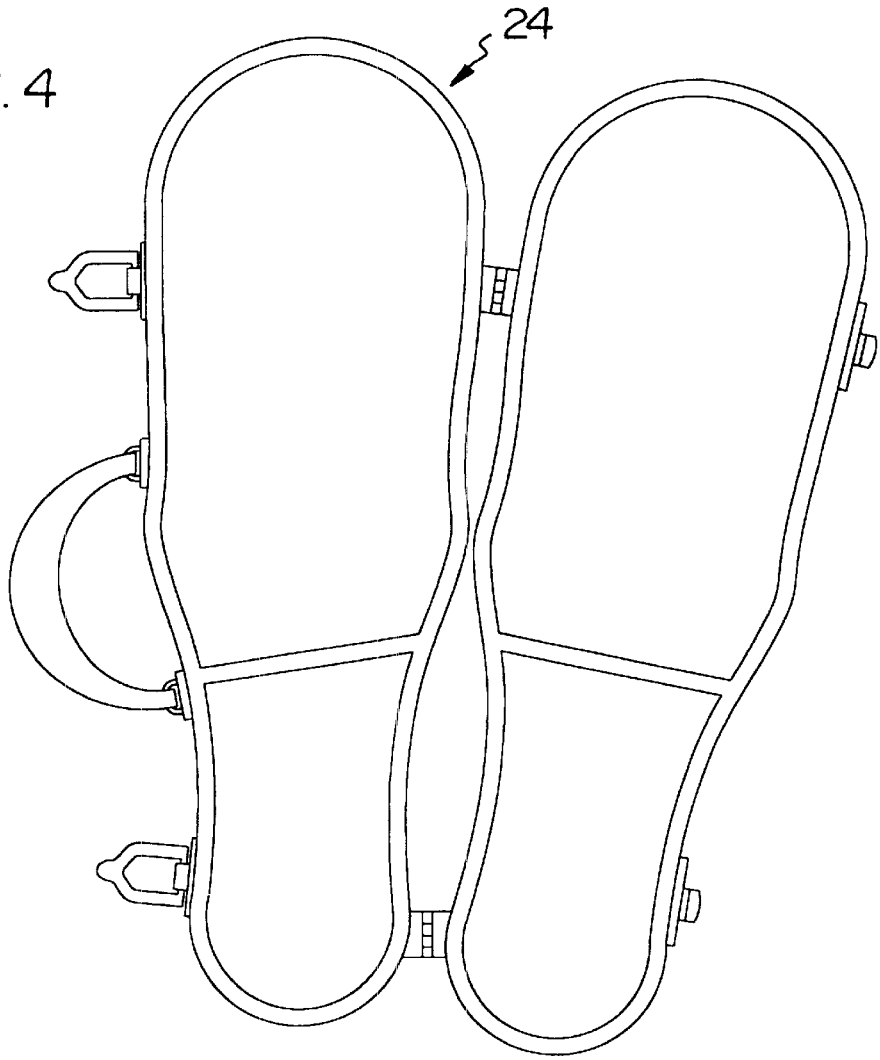
FIG. 4 is a schematic plan view of the game box.
Figure 5:
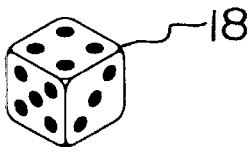
FIG. 5 is a schematic perspective view of the normal die.
Figure 6:
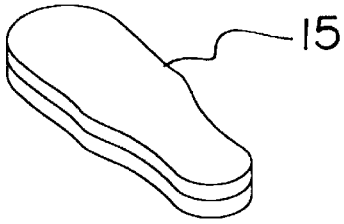
FIG. 6 is a schematic perspective view of a playing piece.

Ideally, a game storage box 24 shaped to resemble a violin case is provided as shown in FIG. 4. The game storage box is adapted for holding therein the game board, the playing pieces, the police record sheets, the play money, the dice, the giant Godfather ring, the trivia cards, the witness protective program cards, the contract cards and the contract recording sheets.

To play, each player is assigned a playing piece and corresponding police record sheet and a contract card and contract recording sheet. One player is assigned to be the banker and each player is also provided with a sum of the play money. Ideally, the sum of play money for each player comprises $100,000 of play money.

The game is played by performing a plurality of sequential player turns with the players performing alternating turns. Each player turn comprising the acts of rolling the normal die and then moving the playing piece of the player a number of sidewalk playing spaces corresponding to the value rolled on the normal die. As the turns are played, the players move along the playing paths to perform the instructions displayed on the sidewalk space on which the playing piece terminates its move on.

When the playing piece terminates a move on the "go to jail" space, the playing piece is moved to the jail space and the player of the respective playing piece on the jail space looses a next subsequent turn.

When the playing piece terminates a move on the "trivia card" space, a trivia card is drawn and the player of the playing piece on the trivia card space is asked the question of the selected trivia card. The player is awarded a sum of play money if the player answers the question of the selected trivia card correctly.

When the playing piece terminates a move on the "Shi-lock" space, the player pays the banker a sum of play money. When the playing piece terminates a move on the picked up for questioning space, the player misses the subsequent turn. A player also misses their subsequent turn when the player's playing piece terminates a move on the "subpoenaed (to appear at Senate hearings)" space.

When the playing piece terminates a move on the "Vegas" space the playing piece is moved to the casino space and the player of the playing piece and the banker are each required to roll a plurality of dice. If the sum of the dice rolled by the player is greater than that of the banker, the player is awarded a sum of play money. Conversely, if the sum of the dice rolled by the player is less than that of the banker, the player then looses their subsequent turn.

As the instructions of the steps of the contact card of the player are performed as play progress, the players record completion of the performed instructions of the steps of their contract card. The first player to complete performance of all of the instructions of all of the steps of their contract card is designated the winner and is awarded the giant Godfather ring.

Below are further details and specifics of this gangster game:

OBJECT OF THE GAME: The object of the game is to become The Godfather. The leader of the Mafia. It's a Gangster Board Game.

PLAYERS: 2 to 12 players although playing with 2 is recommended to really enjoy the game.

THE GAME: The game itself will come in a box that looks like a violin case.

CONTENTS: The game will come with 20 men (player). Each player will receive an actual playing piece plus a police record of that particular character (player piece). The police record will show the character's mug shots, complete with fingerprints, real name and all the alias's, plus anything they may have been either convicted of or suspected in. The board will look like 1 city block with various buildings and land developments that will all be part of the game. The player will move its playing piece around the block on the sidewalk which will have all the instructions. There will also be playing cards (instructions) that will help you play the game. For example: There will be "Contracts", "Trivia", "Witness Protection Program", "Fugezi", "That's a beautiful thing", "45 & A Shovel", plus a various amount of little props related to each card, including $10,000,000 in playing money. There will be 2 sets of Dice, 1 set is normal; the other set is loaded and 1 Giant Godfather Ring. (Winner of the game gets the Godfather Ring).

HOW TO PLAY: Each player chooses one character's police record and becomes that character. Each player also starts the game with $100,000 that will be distributed by the banker. Each player gets 6 "Contract" cards. (The cards aren't chosen by the player; they are randomly chosen with the instructions face down, so the player can't see what they are beforehand.) In order to win the game you have to follow the instructions on each "Contract" exactly and be the first player to finish all your contracts. It is not mandatory that you do one contract at a time; you can try to work all of them at once if you can, as long as at the end, they've all been completed exactly to detail. When a player is acting upon an instruction on a contract, he or she must inform the other players what they are doing for it to be valid. Contracts aren't secrets. (They are only secrets when they are first being handed out.) Once they are handed out, you leave them exposed in front of you. Everyone can know what the other is up to—just to keep things above board. The contracts will have you moving all over the board in order to achieve your goal. It is up to your discretion how to move your man around and in which direction. The player moves its man with a roll of the dice. (The number on the dice indicates the amount of spaces the player moves; only 1 dice is used for this, and it can't be the loaded dice.) Some contracts will have you go to a certain location on the board and purchase an item in order to pull off your contract. The location and price of the item will be listed on the contract, and the money will be given to the banker in exchange for that item. (This is where the props come in, or to simplify it and make it more cost efficient, the banker can give out a piece of paper that will act as a receipt for the purchase.) It is very important that the prop or receipt is acquired because without it, you can't prove you've fulfilled your contract, and therefore it won't be a valid contract. If the player doesn't have the money to purchase the item, they have to continue playing and try to raise it. (There are ample opportunities to make money on the board.) The player starts the game from the "Friend of Ours" restaurant.

THE BANKER: The banker is a very important and key role in the game. The banker controls all the money that will be exchanged throughout the game and validates all contracts. The banker must understand all the rules of the game in order to keep it going, and therefore can act as a referee if there should be any questions raised throughout the playing of the game. The player who wants to be the banker can also be a character in the game, but one role must be separate from the other. They can't be combined. It's okay to be the banker and a character, but your character isn't the banker; that's a different entity. The Banker actually represents the game as opposed to someone playing the game. "The Banker" and the square marked Bank on the board are not the same thing.

SQUARES: Each player moves from square to square on the game, and most squares will mean something to the game. The following are definitions and meanings of the more important squares:

Go to jail: It means you go to jail. There are 3 ways to go to jail. You can be sent there by landing on one of the squares, you can land on the actual jail square or you can draw a card that will send you to jail. Regardless of how you got there, once you go there you automatically miss a turn. After you've missed your turn, there are a few different ways to get out of jail. 1. Another player bails you out with bail set at $200,000. If another player bails you out, you will owe them a "Favor". 2. You can also bail yourself out, but that will cost you $300,000. (Keep in mind that you may need your money to fulfill some of your contracts, so be careful how you spend it.) 3. You can also get out of jail if you have either 5 dirty cops, 3 lawyers, 1 judge or 1 politician in your possession, but if you decide to do it that way, you have to miss another turn and give back the lawyers and/or judge. 4. The other option would be'to turn "States Evidence" and go into the witness protection program. If you decide to go into the Witness Protection Program, it won't cost anything, but you have to start the game all over again with a new identity, and all your contracts will immediately become void. If you do go into the Witness Protection program, you do get to keep whatever money you may have had up until that point, but you have to draw 6 new Contracts and 1 Witness Protection Program Card along with a new character. The Witness Protection Card will be kept a secret because it will tell you whether or not you are actually the new character you chose or an undercover Federal Agent. If you do become an undercover agent, you continue to play the game like normal trying to fulfill your contracts with the intent to finish before everyone else and instead of becoming The Godfather, you win the game by arresting all the other players.

Judge, lawyer, politician, dirty cop: When you land on these squares, you have an option to pay off (bribe them to work for you) these people and have them in your back pocket in case you need them. For example if you go to jail, 1 cop will cost you $2,500. 1 Lawyer will cost you $10,000. 1 Judge will cost you $20,000. 1 Politician will cost you $20,000. As always all money will go to The Banker in exchange for symbol.

Trivia: If you land on the Trivia square, another player will take one of the Trivia cards and read you the questions. Each Trivia question will have anywhere from 1 to 3 questions depending on level of difficulty. All questions will be based on trivia from either real life history or gangster movies. If you answer all the questions right, you get $50,000.

Shi-lock: This card means you owe a shi-lock $50,000, so you have to pay the banker that amount. If you don't have it, you miss a turn.

Picked up for questioning: Miss a turn.

Subpoenaed (to appear at Senate hearings): Miss a turn.

Blank space: It doesn't mean anything; it's just a blank space.

Vegas: Go to the casino and roll all 4 dice (that includes the loaded dice), then the banker (or any other player) have to roll the same dice. If yours add up to more than theirs, you collect $100,000. If yours is lower, you pay it; if you don't have it, you miss a turn Fugezi: You just robbed a jewelry store and got nothing but zircon diamonds; pay $50,000.

That's a beautiful thing: You just smuggled in this top of the line contraband. Collect $100,000.

Cop shop (police station): Pay a $5,000 fine.

Courthouse: Pay a $5,000 fine.

City hall: Pay a $10,000 fine.

45 & A Shovel: This spot gives you the option of doing away with one of your contracts for the small fee of $500,000.

Favors: If at any time of the game you ask someone for a favor, for example they bail you out of jail or you borrow money from them to pay something off instead of missing a turn, you owe them a favor. That favor can be called upon at anytime, and it may also include doing one of their contracts providing the contract is of equal value to the favor. (Each contract will have a monetary value, so you'll know what it's worth compared to what you may owe.) If the person to whom you owe the favor calls you in to do the favor, you have to do it because you owe them. That may include anything from paying a fine of equal value to going to jail for them. Once you pay them back the favor, you're even. If their favor consists of doing a contract for them, but the contract is worth more than what your favor was, they have the option to pay you the difference. As far as the person to whom the favor is owed, they may want to hold onto them for as long as they can and possibly use it when you have one contract left to do in order to win the game. If someone owes you a favor with a value of $150,000 and you have a contract worth $300,000, you can call in the favor and pay them the difference. In this case it would be $150,000.

NOTE: The board itself will represent 1 city block (the turf). Each colored square will represent one of the numbered shops on this page. (The actual board will have photographs in each square representing the shop. For example, a picture of bread will be used to represent The Bakery). The gray area surrounding all the colored boxes represents The Sidewalk. This area will be divided in spaces with instructions written on each space and will be the actual area each player will move his players around the board to get to the shops.

The location playing spaces ideally include the following location playing spaces:

The Casino; Police Station; Court House; City Hall; Friend of Ours Restaurant; Florist; Private Club; Laundromat; Video Store; Convenience Store; Drug Store; Museum; Jewelry Store; Liquor Store; Pizza Place; Bakery; City Morgue; Barber Shop; Law Firm; Pool Hall; Gun Shop; Car Dealership; Auto Body Shop; Hardware Store; Betting House; Movie Theatre; Post Office; Night Club; Furniture Store; Escort Service; Bank; Pawn Shop; Strip Club; Clothing Store; Music Store; Gym; Bus Depot; 38. Airport; Train Station; Shipping Docks (boats, trucks); Cemetery; Photo Studio; Construction Company; Coffee Shop; Butcher Shop; Funeral Home; and Doctor's Office.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A method of playing a gangster board game, comprising the acts of:

providing a plurality of players;

providing a game board having a plurality of playing spaces arranged in an outer sidewalk path;

the playing spaces forming the outer sidewalk path being designated sidewalk playing spaces;

each of the sidewalk playing spaces being having unique playing instructions displayed therein;

providing a plurality of playing pieces each representing a unique player character;

providing a plurality of police record sheets, each police record sheet being associated with a corresponding one of the player characters;

providing a plurality of play money;

providing a plurality of dice;

providing a plurality of contract cards, each contract card having a plurality of steps, each step comprising a set of instructions and an associated cost to be taken from the player's play money for completion of the respective step;

providing a plurality of contract recording sheets, each contract recording sheet having a grid of generally rectangular boxes displayed thereon displayed thereon and indicia indicating contracts along one side of the grid and steps along another side of the grid;

assigning a playing piece and corresponding police record sheet to each player;

providing each player a sum of the play money;

assigning a contract card and a contract recording sheet to each player;

assigning one player to be the banker;

performing a plurality of sequential player turns with the players performing alternating turns, each player turn comprising the acts of:

rolling the normal die;

moving the playing piece of the player a number of sidewalk playing spaces corresponding to the value rolled on the normal die;

performing the instructions displayed on the sidewalk space on which the playing piece terminates its move on;

performing the instructions of the steps of the contact card of the player and paying the cost in the play money associated with the set of instructions; and recording completion of the performed instructions of the steps of the contract card of the player; and designating a winner as the first player to complete performance of all of the instructions of all of the steps of the contract card of the first player.

2. The method of claim 1, wherein the plurality of players comprises between and including two players and twelve players.

3. The method of claim 1, wherein the game board has a road path extending along an outer perimeter of the game board and interposed between the outer sidewalk path and the outer perimeter of the game board.

4. The method of claim 1, additionally comprising providing a game board having a plurality of playing spaces arranged in an inner location path, wherein the playing spaces forming the inner location path are designated location playing spaces, wherein each of the location playing spaces are assigned a unique game location and location playing spaces, and wherein the location playing spaces include a jail space, and wherein a playing piece is moved to the jail space when the playing piece terminates a move on the go to jail space, and wherein the player of the respective playing piece on the jail space loses a next subsequent turn.

5. The method of claim 4, wherein the location playing spaces includes a casino space, wherein the sidewalk playing spaces include a Vegas space, wherein the playing piece is moved to the casino space when the playing piece terminates a move on the Vegas space, the player of the playing piece rolling a plurality of dice, the banker rolling a plurality of dice, awarding the player a sum of the play money if the sum of the dice rolled by the player is greater than that of the banker, the player missing a subsequent turn if the sum of the dice rolled by the player is less than that of the banker.

6. The method of claim 1, additionally comprising providing a deck of trivia cards; and wherein the act of performing a player turn further comprises the acts of: drawing a trivia card when the playing piece terminates a move on the trivia card space, asking the question of the selected trivia card to the player of the playing piece on the trivia card space, awarding the player a sum of play money if the player answers the question of the selected trivia card correctly.

7. A method of playing a gangster board game, comprising the acts of:

providing a plurality of players, wherein the plurality of players comprises between and including two players and twelve players;

providing a generally rectangular game board having a generally rectangular outer perimeter, a plurality of generally rectangular playing spaces arranged in a pair of generally rectangular paths along the outer perimeter of the game board;

the pair of paths including an inner location path and an outer sidewalk path, the outer sidewalk path being interposed between the inner location path and the outer perimeter of the game board;

the game board having a generally rectangular road path extending along the outer perimeter and interposed between the outer sidewalk path and the outer perimeter of the game board;

the playing spaces forming the inner location path being designated location playing spaces and the playing spaces forming the outer sidewalk path being designated sidewalk playing spaces;

each of the location playing spaces being assigned a unique game location and having indicia indicating the unique game location of the respective location playing spaces;

the location playing spaces including a jail space;

the location playing spaces including a casino space;

each of the sidewalk playing spaces being having unique playing instructions displayed therein;

the sidewalk playing spaces including a go to jail sidewalk playing space;

the sidewalk playing spaces including judge, lawyer, politician, dirty cop spaces;

the sidewalk playing spaces including a trivia space;

the sidewalk playing spaces including a Shi-lock space;

the sidewalk playing spaces including a picked up for questioning space;

the sidewalk playing spaces including a subpoenaed (to appear at Senate hearings) space;

the sidewalk playing spaces including a Vegas space;

the sidewalk playing spaces including a That's a beautiful thing space;

the sidewalk playing spaces including a 45 & A Shovel space;

providing a plurality of playing pieces each representing a unique player character, wherein the plurality of playing pieces comprises 20 playing pieces;

providing a plurality of police record sheets, each police record sheet being associated with a corresponding one of the player characters;

each of the police record sheets displaying a simulated mug shot, a simulated set of fingerprints, name, aliases, and simulated prior convictions of the corresponding player character;

providing a plurality of play money in a variety of denominations having a sum of at least $10,000,000 of play money;

providing a plurality of dice, the plurality of dice including a normal die, and a loaded die;

providing a giant Godfather ring;

providing a deck of trivia cards, each trivia card having a trivia question and corresponding correct answer relating to an organized crime subject displayed thereon;

providing a plurality of contract cards, each contract card having a plurality of steps, each step comprising a set of instructions and an associated cost for the respective step;

providing a plurality of contract recording sheets, each contract recording sheet having a grid of generally rectangular boxes displayed thereon displayed thereon and indicia indicating contracts along one side of the grid and steps along another side of the grid;

providing a game storage box shaped to resemble a violin case, the game storage box being adapted for holding therein the game board, the playing pieces, the police record sheets, the play money, the dice, the giant Godfather ring, the trivia cards, the witness protective program cards, the contract cards and the contract recording sheets;

assigning a playing piece and corresponding police record sheet to each player;

providing each player a sum of the play money, wherein the sum of play money for each player comprises $100,000 of play money;

assigning a contract card and a contract recording sheet to each player;

assigning one player to be the banker;

performing a plurality of sequential player turns with the players performing alternating turns, each player turn comprising the acts of:

rolling the normal die;

moving the playing piece of the player a number of sidewalk playing spaces corresponding to the value rolled on the normal die;

performing the instructions displayed on the sidewalk space on which the playing piece terminates its move [on];

moving a playing piece to the jail space when the playing piece terminates a move on the go to jail space, wherein the player of the respective playing piece on the jail space losing a next subsequent turn;

drawing a trivia card when the playing piece terminates a move on the trivia card space, asking the question of the selected trivia card to the player of the playing piece on the trivia card space, awarding the player a sum of play money if the player answers the question of the selected trivia card correctly;

paying the banker a sum of play money when the playing piece terminates a move on the Shi-lock space;

missing a subsequent turn when the playing piece terminates a move on the picked up for questioning space;

missing a subsequent turn when the playing piece terminates a move on the subpoenaed (to appear at Senate hearings) space;

moving the playing piece to the casino space when the playing piece terminates a move on the Vegas space, the player of the playing piece rolling a plurality of dice, the banker rolling a plurality of dice, awarding the player a sum of play money if the sum of the dice rolled by the player is greater than that of the banker, the player missing a subsequent turn if the sum of the dice rolled by the player is less than that of the banker;

performing the instructions of the steps of the contract card of the player;

recording completion of the performed instructions of the steps of the contract card of the player;

designating a winner as the first player to complete performance of all of the instructions of all of the steps of the contract card of the first player; and awarding the giant Godfather ring to the winner.

* * * * *